US010090139B2

(12) United States Patent
Yamamura

(10) Patent No.: US 10,090,139 B2
(45) Date of Patent: Oct. 2, 2018

(54) MASS ANALYSIS DEVICE

(71) Applicant: SHIMADZU CORPORATION, Kyoto-shi, Kyoto (JP)

(72) Inventor: Yutaro Yamamura, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 14/514,805

(22) Filed: Oct. 15, 2014

(65) Prior Publication Data

US 2016/0111268 A1 Apr. 21, 2016

(51) Int. Cl.
*H01J 49/26* (2006.01)
*H01J 49/00* (2006.01)

(52) U.S. Cl.
CPC ..... *H01J 49/0036* (2013.01)

(58) Field of Classification Search
USPC ..... 250/282
See application file for complete search history.

(56) References Cited

U.S. PATENT DOCUMENTS 3,686,923 A * 8/1972 Favre ..... G01N 30/10 422/70
7,384,387 B1 6/2008 Raillard et al.
8,754,365 B2 * 6/2014 Krechmer ..... H01J 49/049 250/281
2011/0054804 A1 * 3/2011 Pfaff ..... G01N 30/72 702/25
2013/0080073 A1 * 3/2013 de Corral ..... G01N 30/86 702/23

FOREIGN PATENT DOCUMENTS

| | | |
|---|---|---|
| JP | H05-164751 | 6/1993 |
| JP | H08-5624 | 1/1996 |
| JP | H085624 | 1/1996 |
| JP | 2003-524394 | 8/2003 |
| JP | 2008-002895 | 1/2008 |
| JP | 2008-145221 | 6/2008 |
| JP | 2009-008582 | 1/2009 |

OTHER PUBLICATIONS

R. B. Frederiksen, "Optimize Peak Detection & Integration with ApexTrack/Processing Theory", Waters Corp. Pub., 2011, pp. 1-25.*

(Continued)

*Primary Examiner* — Phillip A Johnston
(74) *Attorney, Agent, or Firm* — Sughrue Mion, PLLC

(57) ABSTRACT

A mass analysis device capable of reliably detecting the peak in a mass chromatogram of a given m/z is equipped with a control unit, which generates a mass chromatogram and total ion chromatogram. The control unit includes a determination unit which, using the total ion chromatogram, determines the start time and end time of the peak in the total ion chromatogram by searching for the peak based on maximum value of detected intensity and searching for peak start time and end time based on slope of change of detected intensity; and a detection unit, which detects the peak in the mass chromatogram by making the start time and end time of the peak in the mass chromatogram the same as the start time and end time of the peak in the total ion chromatogram.

20 Claims, 7 Drawing Sheets

(56) References Cited

OTHER PUBLICATIONS

Frederiksen, "Optimize Peak Detection & Integration with ApexTrack/Processing Theory", Waters Corp. Pub., 2011; pp. 1-59.*
Japanese Office Action dated Oct. 27, 2015 in corresponding Japanese Patent Application No. 2012-084846.
Cody et al., "Versatile New Ion Source for the Analysis of Materials in Open Air under Ambient Conditions", Analytical Chemistry, 2005, vol. 77, pp. 2297-2302.
Cody et al., "Direct Analysis in Real Time (DART) Mass Spectrometry", 2005, JEOL News, vol. 40, No. 1, pp. 16-25.
"Dart Technology: A new ionization for rapid non-contact surface sampling of compounds", IonSense Inc.

* cited by examiner

MASS ANALYSIS DEVICE

TECHNICAL FIELD

The present invention relates to mass analysis devices; more specifically, the invention relates to mass analysis devices for analyzing specific components such as metabolites contained in blood.

BACKGROUND ART

It is currently known that, depending on the type of disease to be diagnosed, there are cases where, if a healthy person is compared to an afflicted person, the content of a specified component in the blood will differ drastically. Thus, diagnosis of such diseases is performed by investigating the content of a specified component in the blood. Furthermore, with this sort of diagnostic method for diseases, it is necessary to analyze samples collected from numerous subjects. Thus, a screening test is performed as the primary test so as not to increase the work load.

Mass analysis methods, in which metabolites in blood are subjected to mass analysis, are considered to be important as screening tests. Devices using a mass analysis method include atmospheric pressure ionization mass analysis devices in which ions of sample molecules are generated under atmospheric pressure and the obtained ions are placed into a vacuum and analyzed. Furthermore, atmospheric pressure ionization mass analysis devices employ a flow injection method as the sample introduction method, whereby the sample solution is analyzed while being fed (for example, see Patent Literature 1). With the flow injection method, analysis is performed without performing separation of components by a column, thus allowing samples to be analyzed in a shorter time. Thus, it is employed for screening tests, where it is necessary to analyze a lot of samples. Furthermore, a mass analysis method is combined with other ionization method such as direct ionization by which ion is ionized with laser radiation or Direct Analysis in Real Time (DART) ionization by which ion is ionized with ionized gas. (for example, see non-Patent Literature 1)

FIG. 8 is a schematic diagram illustrating an example of an atmospheric pressure ionization mass analysis device employing a flow injection method. The atmospheric pressure ionization mass analysis device 101 comprises an MS 10 and a computer (control unit) 130. In MS 10, an ionization chamber 11, a first intermediate chamber 12 adjacent to the ionization chamber 11, a second intermediate chamber 13 adjacent to the first intermediate chamber 12, and a mass analysis chamber 14 adjacent to the second intermediate chamber 13 are consecutively arranged across partition walls. Inside the mass analysis chamber 14, there is provided a first mass analysis unit 16, a collision cell 26, a second mass analysis unit 17, and a detector 18. Furthermore, an inert gas such as argon gas is introduced into the collision cell 26.

In this sort of atmospheric pressure ionization mass analysis device 101, the sample solution and nitrogen gas (nebulizer gas) are sprayed into the ionization chamber 11 by a sprayer (probe) 15. FIG. 9 (*a*) is side view of the sprayer, and FIG. 9 (*b*) is an enlarged cross-sectional view of A shown in FIG. 9 (*a*).

Sprayer 15 has a double pipe structure, and the sample solution is sprayed out from the inside of round pipe 159. Furthermore, nitrogen gas is sprayed out from the space between round pipe 159 and round tubular nozzle 152. This arrangement causes the sprayed out sample solution to be atomized in the form of a mist due to the effect of collision with the nitrogen gas sprayed out around the round pipe 159. Furthermore, a wire (not illustrated) is connected to the tip of the nozzle 152 so as to apply a high voltage of several kV from a voltage source (not illustrated), whereby ionization is performed.

In this way, sample solution which successively flows out from the sprayer 15 becomes ionized. The ions generated as a result in the ionization chamber 11 are fed in sequence through solvent removal tube 19, first ion lens 21 inside first intermediate chamber 12, skimmer 22, octapole 23 and focus lens 24 inside second intermediate chamber 13, and input lens 25, into the mass analysis chamber 14. Ions which have been fed into the mass analysis chamber 14 are subjected to elimination of unneeded ions by means of the quadrupole inside the first mass analysis unit 16, ions are destroyed in collision cell 26, unneeded ions are further eliminated by means of the quadrupole inside second mass analysis unit 17, and only ions of a specified mass m/charge z which have reached the detector 18 are detected.

Here, only ions with m/z corresponding to the applied voltage selectively pass through the quadrupoles inside the first mass analysis unit 16 and the second mass analysis unit 17, to which a voltage is applied in which a direct current voltage and a high frequency voltage are superimposed, and thus, precursor ions which are to be allowed through the first mass analysis unit 16 and product ions which are to be allowed through the second mass analysis unit 17 are selected, and voltage is applied so that only ions with the selected m/z will pass through. Once the precursor ions and product ions corresponding to the component to be measured are selected, ions with the m/z corresponding to the product ions will pass through the first mass analysis unit 16 and be dissociated in the collision cell 26, and the corresponding product ions will pass through the second mass analysis unit 17 and arrive at the detector 18. The m/z of ions which pass through the quadrupole depends on the applied voltage, so by scanning the applied voltage, ion intensity signals for ions of multiple m/z ratios of interest are acquired in the detector 18. The information (ion intensity signal) acquired in the detector 18 is then outputted to a computer 130.

The computer 130 comprises a CPU 131, and is further connected to a memory 132, a keyboard 33*a* and mouse 33*b*, which are input devices, and a display device 34 comprising a monitor screen 34*a* and the like. In the detector 18, the sample is cleaved into individual ions, and the ion intensity is detected for each m/z. By repeating this measurement at short time intervals, multiple mass spectra are generated, with m/z on the horizontal axis and detected intensity on the vertical axis. Furthermore, focusing one's interest on the detected intensity of ions with a given m/z among the detected intensities of ions of multiple m/z ratios, by arranging the detected intensity of ions with the m/z of interest in the time axis direction, a mass chromatogram is generated. Moreover, by adding together mass chromatograms for multiple m/z ratios of interest, a total ion chromatogram is generated.

As a result, in the screening test, by computing the content of a specified component on the basis of peak area value and detected intensity value appearing on the mass chromatogram of a given m/z corresponding to the specified component, the tester, etc. finds samples in which the content of the specified component differs drastically from among a large number of samples.

PRIOR ART DOCUMENTS

Patent Literatures (Patent Literature 1) Japanese Unexamined Patent Application Publication H8-005624

(non-Patent Literature 1) Versatile New Ion Source for the Analysis of Materials in Open Air under Ambient Conditions, Robert B. Cody et al., Analytical Chemistry, 2005, 77 (8), pp 2297-2302

SUMMARY OF THE INVENTION

Problem to be Solved by the Invention

However, in an atmospheric pressure ionization mass analysis device 101 as described above, unless the appropriate analysis parameters are set, it may not be possible to accurately compute the content of the specified component in the blood. Furthermore, it may not be possible to accurately compute the content of the specified component in the blood if the atmospheric pressure ionization mass analysis device 101 itself is not kept in good condition. Thus, in screening tests using the atmospheric pressure ionization mass analysis device 101, subjects which are actually ill may be erroneously judged to not be afflicted.

Means for Solving the Problem

To resolve the problem described above, the present inventors investigated screening test methods using an atmospheric pressure ionization mass analysis device 101. In a screening test, numerous samples are analyzed one after next. Thus, the atmospheric pressure ionization mass analysis device 101 becomes contaminated, keeping the atmospheric pressure ionization mass analysis device 101 itself in good condition becomes difficult, and reduction in detected intensity and time axis shifts occur. Thus, to accurately compute the content of a specified component in blood, there arises the need to set appropriate analytical parameters during the screening test and to keep the atmospheric pressure ionization mass analysis device 101 itself in good condition. Furthermore, depending on the type of disease to be diagnosed, the content of the specified component in blood will differ drastically when a healthy person is compared to an afflicted person.

Accordingly, since there is a need to set the appropriate analytical parameters and to keep the atmospheric pressure ionization mass analysis device 101 itself in good condition in order to accurately measure the content of a specified component in blood, it was decided not just to compute the content of the specified component in blood, but to also align total ion chromatograms for each of the samples and then display m/z mass chromatograms for multiple samples, so as to make it easier of the tester, etc. to find samples with a drastically differing content of the specified component.

Furthermore, when using a mass chromatogram of a given m/z to search for a peak based on maximum value of detected intensity and searching for peak start time and end time based on slope of change of detected intensity so as to determine the maximum value of detected intensity of a peak and the peak start time and end time on the mass chromatogram of the given m/z, there were cases where the peak could not be detected due to low content of ions of that m/z in the blood.

Thus, it was decided to introduce the sample using a flow injection method and use a total ion chromatogram, making the start time and end time of the peak on the mass chromatogram of the given m/z the same as the start time and end time of the peak on the total ion chromatogram, in order to detect the peak on the mass chromatogram of the given m/z.

Namely, the mass analysis device of the present invention is a mass analysis device equipped with an ionization chamber which ionizes a sample introduced using a flow injection method; a mass analysis unit into which ions are introduced from said ionization chamber; and a control unit which, based on the information acquired by said mass analysis unit, generates a mass chromatogram representing the relationship between detected intensity and time for ions of a given m/z and a total ion chromatogram representing the relationship between detected intensity and time for all ions, wherein said control unit comprises a determination unit which, using said total ion chromatogram, determines the start time and end time of the peak in said total ion chromatogram by searching for the peak based on maximum value of detected intensity and searching for peak start time and end time based on slope of change of detected intensity; and a detection unit which detects the peak in said mass chromatogram by making the start time and end time of the peak in said mass chromatogram the same as the start time and end time of the peak in said total ion chromatogram.

Effect of the Invention

With the mass analysis device of the present invention, as described above, even if the content of ions of a particular m/z corresponding to the component in blood to be measured is low, since the content of all the ions corresponding to the component to be measured will be greater, the peak on the mass chromatogram of the given m/z can be more reliably detected by using a total ion mass chromatogram.

Other Means for Solving the Problem, and Effect

Furthermore, optionally, the mass analysis device of the present invention comprises a ionization source which ionizes a sample introduced without separation, Furthermore, optionally, the mass analysis device of the present invention comprises a storage unit which stores a reference total ion chromatogram and a reference mass chromatogram of a given m/z obtained upon analyzing a reference sample, and said control unit comprises: a computation unit which computes a time correction value for performing conversion such that the start time and end time of the peak in said total ion chromatogram will become the same as the start time and end time of the peak in said reference total ion chromatogram, and computes a detected intensity correction value for performing conversion such that the maximum value of detected intensity of the peak in said total ion chromatogram will become the same as the maximum value of detected intensity of the peak in said reference total ion chromatogram; a correction unit which, by correcting the relationship between detected intensity and time for ions of a given m/z in said mass chromatogram using said time correction value and detected intensity correction value, generates a corrected mass chromatogram representing the relationship between detected intensity and time for ions of the given m/z; and a comparison unit for comparing the maximum value of detected intensity of the peak in said corrected mass chromatogram and the maximum value of detected intensity of the peak in said reference mass chromatogram.

Here, "reference sample" may be either a sample collected from a healthy person or the first sample on which a screening test is performed.

The mass analysis device of the present invention not only computes the content of a specified component in blood but also aligns a reference total ion chromatogram for a reference sample and a total ion chromatogram for a sample and then compares an m/z reference mass chromatogram for a reference sample and an m/z corrected mass chromatogram for a sample, thus allowing the tester, etc. to more easily judge if the content of the specified component is different.

Furthermore, in the mass analysis device of the present invention, said comparison unit may display said corrected mass chromatogram and reference mass chromatogram.

Moreover, in the mass analysis device of the present invention, said storage unit may store a maximum value difference threshold value, and said comparison unit may determine if the difference between the maximum value of detected intensity of the peak in said corrected mass chromatogram and the maximum value of detected intensity of the peak in said reference mass chromatogram is at or above said maximum value difference threshold value.

Here, "maximum value difference threshold value" is a numerical value for judging that the content of a specified component in the blood is that of a healthy person, and is an arbitrary numerical value determined in advance by the tester, etc.

DETAILED DESCRIPTION OF THE EXEMPLARY EMBODIMENTS

A mode of embodiment of the present invention will be described below using the drawings. It should be noted that the present invention is not limited to the mode of embodiment described below, and includes various modes so long as they do not depart from the gist of the present invention.

Figure 1:
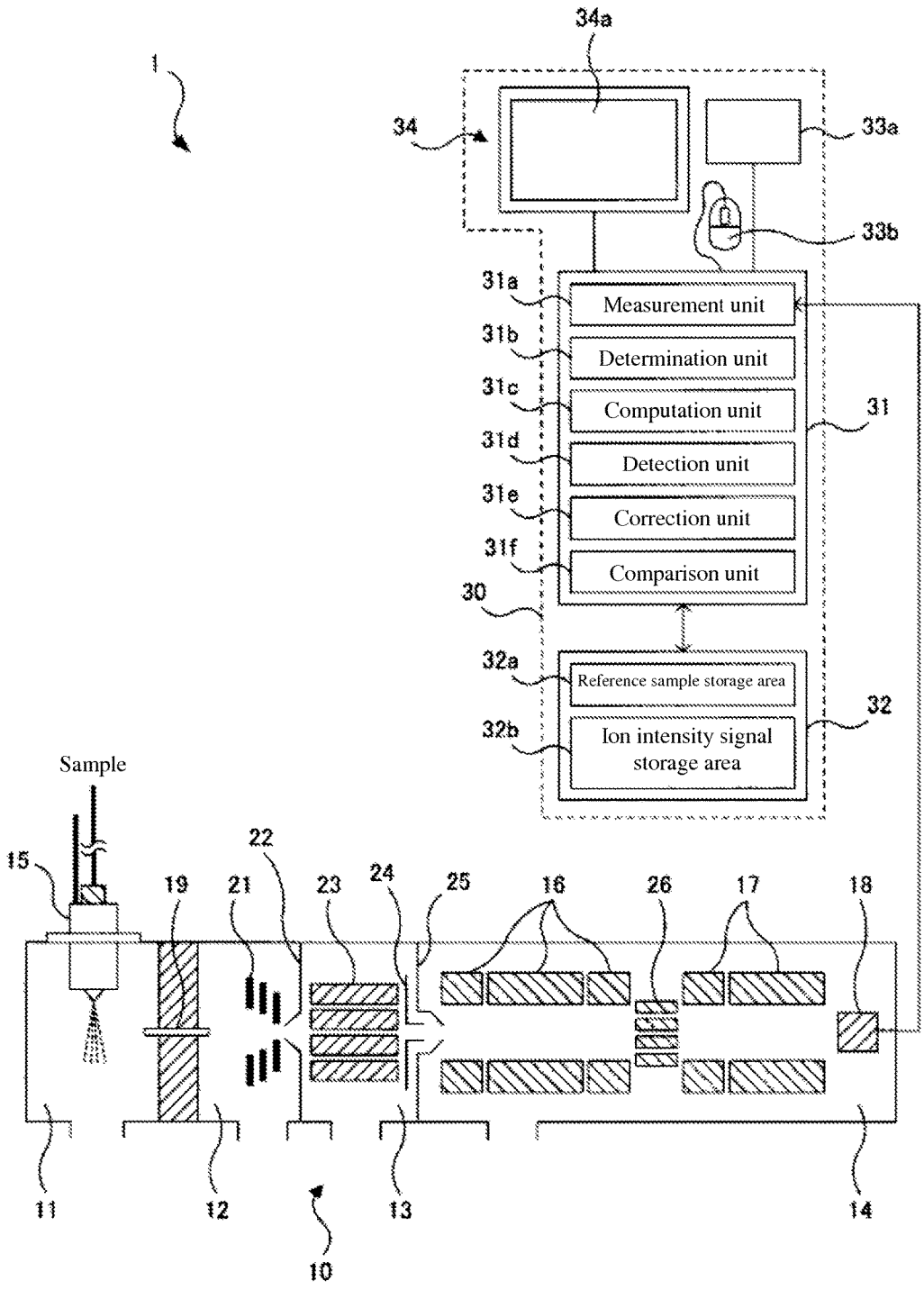
FIG. 1 A schematic diagram illustrating an example of an atmospheric pressure ionization mass analysis device using a flow injection method according to the present invention.

FIG. 1 is a schematic diagram illustrating an example of an atmospheric pressure ionization mass analysis device using a flow injection method according to the present invention. The atmospheric pressure ionization mass analysis device 1 of the present embodiment is used, for example, for computing the content of ions of an m/z corresponding to a specified component related to some disease in biologically derived samples Sn such as blood or urine, so as to thereby find subjects which may be afflicted from among a large number of subjects. Components which are the same as in the conventional atmospheric pressure ionization mass analysis device described above have been assigned the same reference symbols.

Atmospheric pressure ionization mass analysis device 1 comprises an MS 10 and a computer (control unit) 30. In MS 10, an ionization chamber 11 which is an ion source, a first intermediate chamber 12 adjacent to the ionization chamber 11, a second intermediate chamber 13 adjacent to the first intermediate chamber 12, and a mass analysis chamber 14 adjacent to the second intermediate chamber 13 are consecutively arranged across partition walls. Inside the mass analysis chamber 14, there is provided a first mass analysis unit 16, a collision cell 26, a second mass analysis unit 17, and a detector 18.

The computer 30 comprises a CPU 31, and is further connected to a memory 32, a keyboard 33*a* and mouse 33*b*, which are input devices, and a display device 34 comprising a monitor screen 34*a* and the like. To explain the functions processed by the CPU 31 in terms of blocks, there is provided a measurement unit 31*a* which generates a total ion chromatogram and mass chromatogram; a determination unit 31*b* which determines the maximum value imax of detected intensity of the peak and the peak start time is and end time to on the total ion chromatogram; a computation unit 31*c* which computes a start time correction value A, end time correction value B and detected intensity correction value C; a detection unit 31*d* which detects the peak on the mass chromatogram; a correction unit 31*e* which generates a corrected mass chromatogram; and a comparison unit 31*f* which displays a corrected mass chromatogram and reference mass chromatogram.

Furthermore, the memory 32 comprises a reference sample storage area 32*a* which stores a reference total ion chromatogram, m/z reference mass chromatogram and maximum value difference threshold value ΔIm/zth; and an ion intensity signal storage area 32*b*. It should be noted that FIG. 2 (*a*) is one example of a reference total ion chromatogram. The reference total ion chromatogram was obtained upon analyzing a reference sample (sample 1) S1, having a peak with a maximum value Imax of detected intensity, start time Ts and end time Te. Furthermore, the m/z reference mass chromatogram was obtained upon analysis of reference sample (sample 1) S1, having a peak with a maximum value Im/zmax of detected intensity, start time Ts and end time Te. Maximum value difference threshold value ΔIm/zth is a numerical value for judging that the content of ions with an m/z corresponding to a specified component in blood (total ion chromatogram) is not that of a healthy person.

Figure 2:
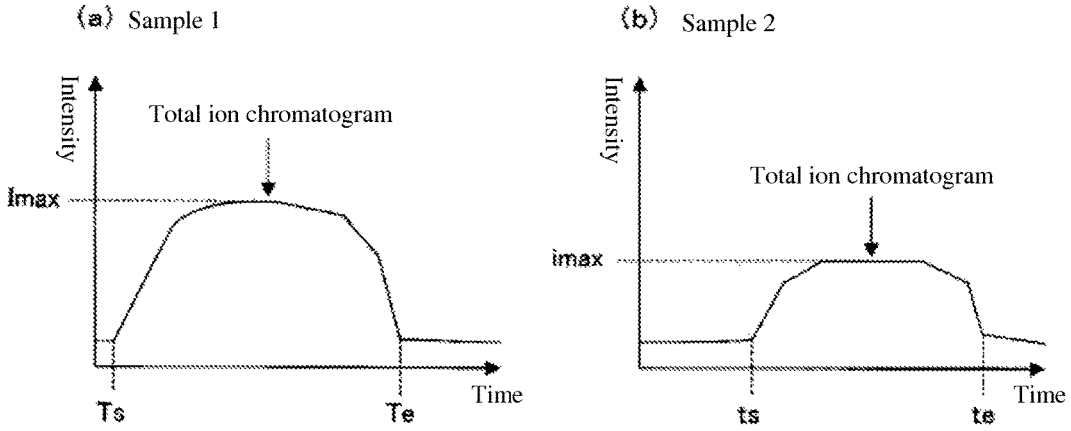
FIG. 2 An example of a total ion chromatogram.

Measurement unit 31*a* performs control so as to store ion intensity signals acquired by detector 18 in ion intensity signal storage area 32*b* and then generate a mass spectrum by taking the detected intensity as the vertical axis and m/z as the horizontal axis. Here, by successively repeating mass scanning intermittently at set intervals, multiple mass spectra are obtained corresponding to the outflow time of the sample which successively flows out from the sprayer 15. Then, the measurement unit 31*a*, based on the multiple mass spectra and focusing on a given m/z, performs control to extract the detected intensity over the time axis direction so as to generate a mass chromatogram for the given m/z, and to store that mass chromatogram in the ion intensity signal storage area 32*b*. Moreover, control is performed to generate a total ion chromatogram by adding up the detected intensities of multiple ions appearing in a single mass spectrum and arranging it in the time axis direction, and to store that total ion chromatogram in ion signal intensity storage area 32*b*. FIG. 2 (*b*) is an example of a total ion chromatogram obtained upon analysis of sample S2.

Figure 3:
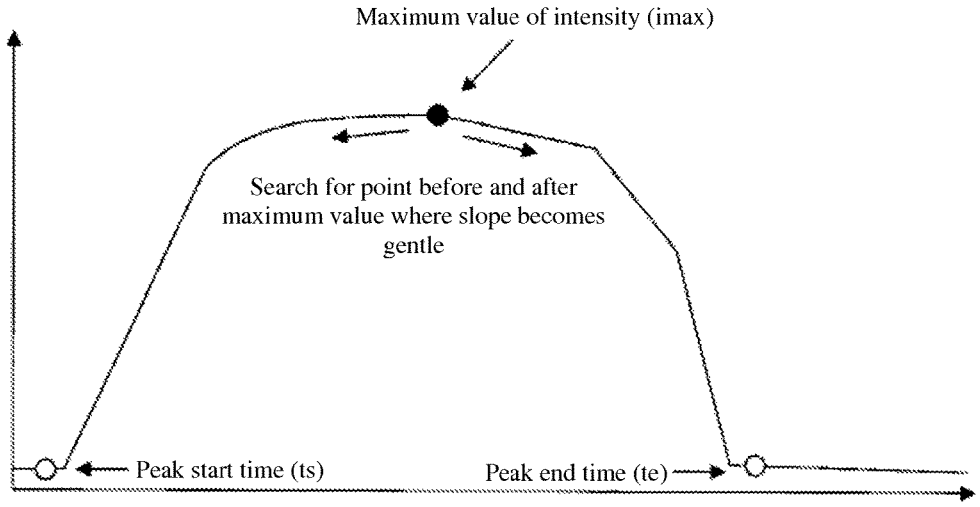
FIG. 3 An explanatory diagram of the determination of maximum value of detected intensity of the peak in a total ion chromatogram and peak start time and end time.

Determination unit 31*b*, using the total ion chromatogram stored in ion intensity signal storage area 32*b*, performs control to determine the time when the slope of change of detected intensity becomes gentle as the peak end time te by searching for the peak based on the maximum value imax of detected intensity and going forward from the time of maximum value imax of detected intensity, and to determine the time when the slope of change of detected intensity becomes gentle as the peak start time ts by going back from the time of maximum value imax of detected intensity. FIG. 3 is an explanatory diagram of the determination of maximum value imax of detected intensity of the peak in a total ion chromatogram and peak start time ts and end time te. Based on this, the total ion chromatogram obtained when sample S2 is analyzed, as shown in FIG. 2 (*b*), will have the maximum value imax of detected intensity, start time ts and end time te for the peak in question.

The computation unit 31*c*, based on the following formulas (1) through (3), performs control to compute a start time correction value A and end time correction value B for performing conversion such that the start time ts and end time te of the peak in the total ion chromatogram will be the same as the start time Ts and end time Te of the peak in the reference total ion chromatogram, and to compute a detected intensity correction value C for performing conversion such that the maximum value imax of detected intensity of the peak in the total ion chromatogram will be the same as the maximum value Imax of detected intensity of the peak in the reference total ion chromatogram.

$$ts \times A = Ts \quad (1)$$

$$te \times B = Te \quad (2)$$

$$i\max \times C = I\max \quad (3)$$

Figure 4:
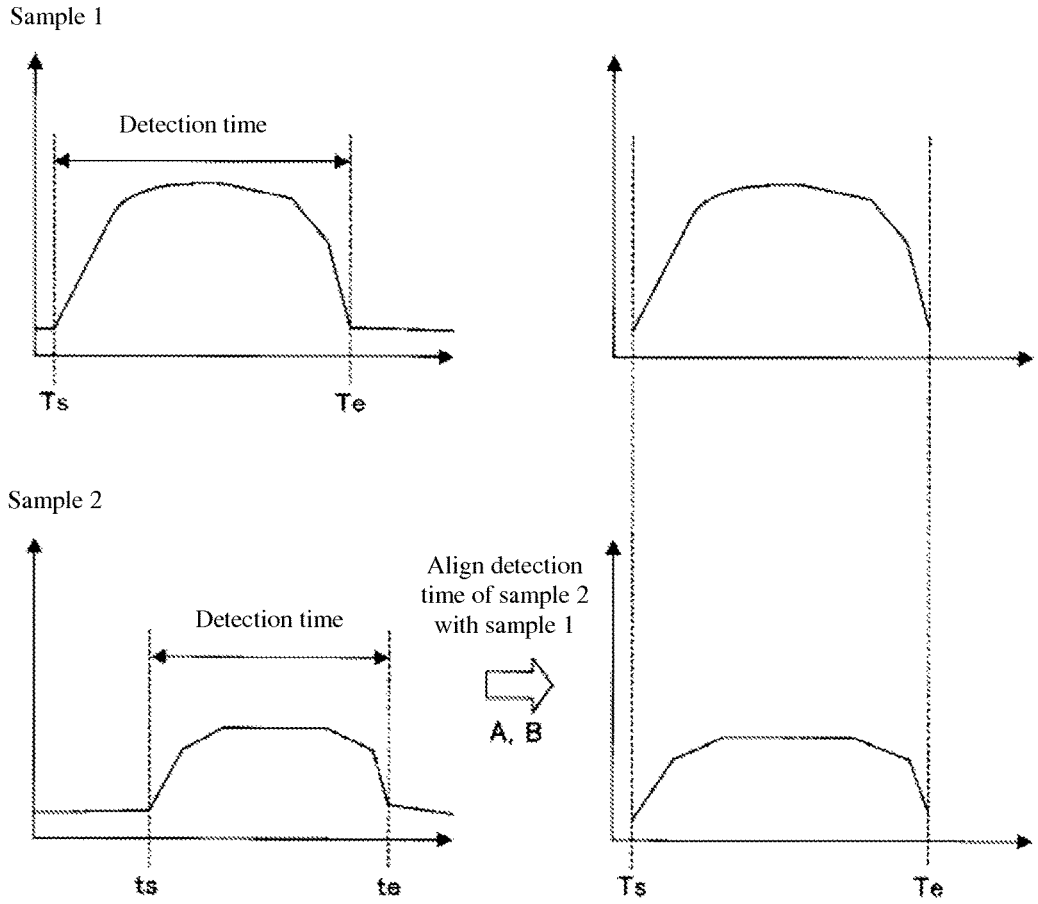
FIG. 4 An explanatory diagram of time correction value computation.
Figure 5:
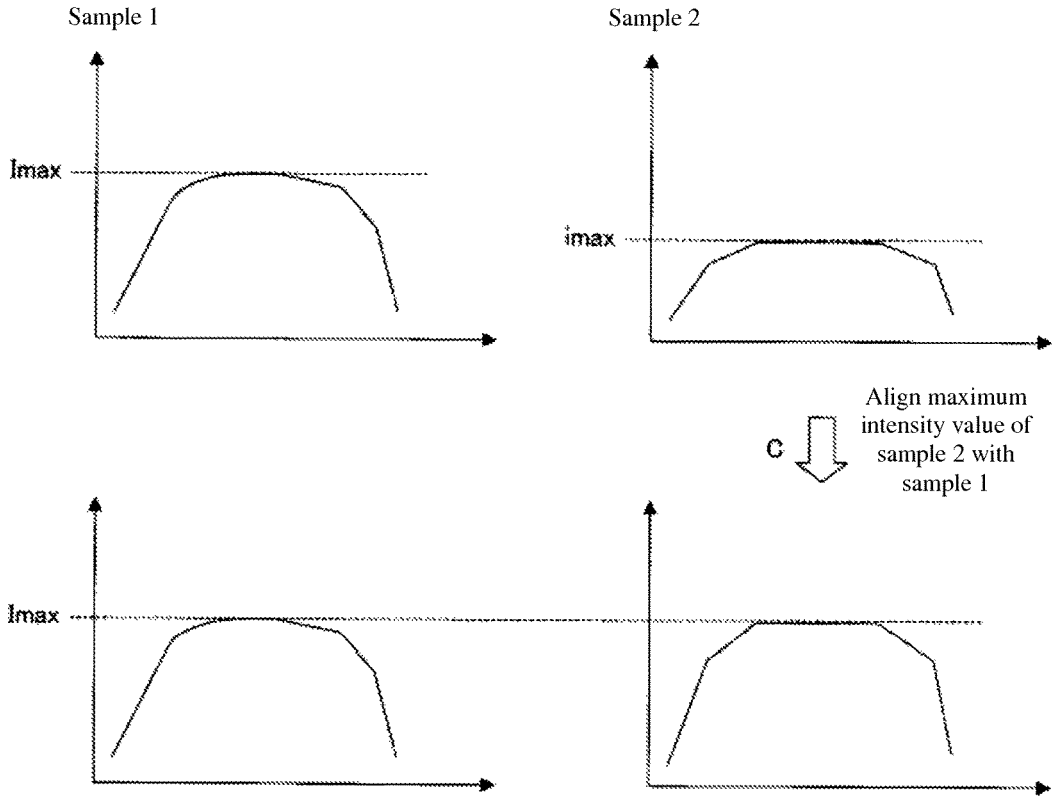
FIG. 5 An explanatory diagram of detected intensity correction value computation.

FIG. 4 is a diagram intended to explain the computation of start time correction value A and start time correction value B, and FIG. 5 is a diagram intended to explain the computation of detected intensity correction value C. Based on this, the total ion chromatogram obtained when the sample S2 is analyzed and the reference total ion chromatogram become substantially overlapping.

Detection unit 31*d* performs control to detect the peak in a mass chromatogram of a given m/z by making the peak start time ts and end time te in the mass chromatogram of a given m/z the same as the peak start time ts and end time te in the total ion chromatogram. As a result, even if the content of ions with the m/z of interest is low, since the total content of ions will be greater, by using a total ion chromatogram, the peak in the m/z mass chromatogram can be reliably detected.

Correction unit 31*e* performs control to generate a corrected mass chromatogram representing the relationship between the detection intensity and time for ions of a given m/z by correcting the relationship between detected intensity and time for ions of that m/z in a mass chromatogram for that m/z using a start time correction value A, end time correction value B and detected intensity correction value C.

$$ts \times A = ts' \quad (4)$$

$$te \times B = te' \quad (5)$$

$$im/z\max \times C = im/z\max' \quad (6)$$

Figure 6:
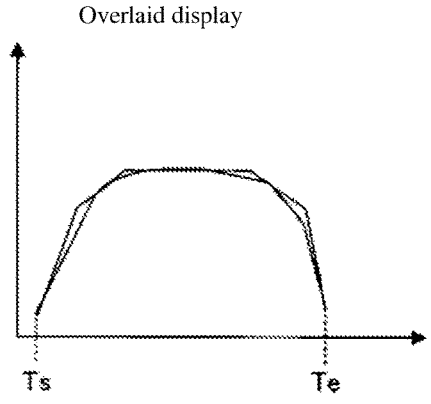
FIG. 6 A drawing illustrating an example of an image wherein mass chromatograms have been displayed.

Comparison unit 31*f* performs control to overlay the corrected mass chromatogram of a given m/z and the reference mass chromatogram of the given m/z and display them on the monitor screen 34*a*. FIG. 6 is a drawing illustrating an example of an image wherein a corrected mass chromatogram of a given m/z and a reference mass chromatogram of a given m/z have been displayed. The comparison unit 31*f* further determines if the difference between the maximum value im/zmax' of detected intensity of the peak on the corrected mass chromatogram and the maximum value Imax of detected intensity of the peak on the reference mass chromatogram is at or above the maximum value difference threshold value ΔIm/zth, and if it is at or above the maximum value difference threshold value ΔIm/zth, the comparison unit 31*f* performs image display wherein the corrected mass chromatogram in question is changed to a dashed line or its color is changed. Namely, after aligning the reference total ion chromatogram for the reference sample (sample 1) S1 and the total ion chromatogram for the sample (sample 2) S2, an m/z reference mass chromatogram for the reference sample (sample 1) S1 and an m/z corrected mass chromatogram for the sample (sample 2) S2 are displayed, thus making it possible for the tester, etc. to easily judge if the content of ions of that m/z is drastically different.

Figure 7:
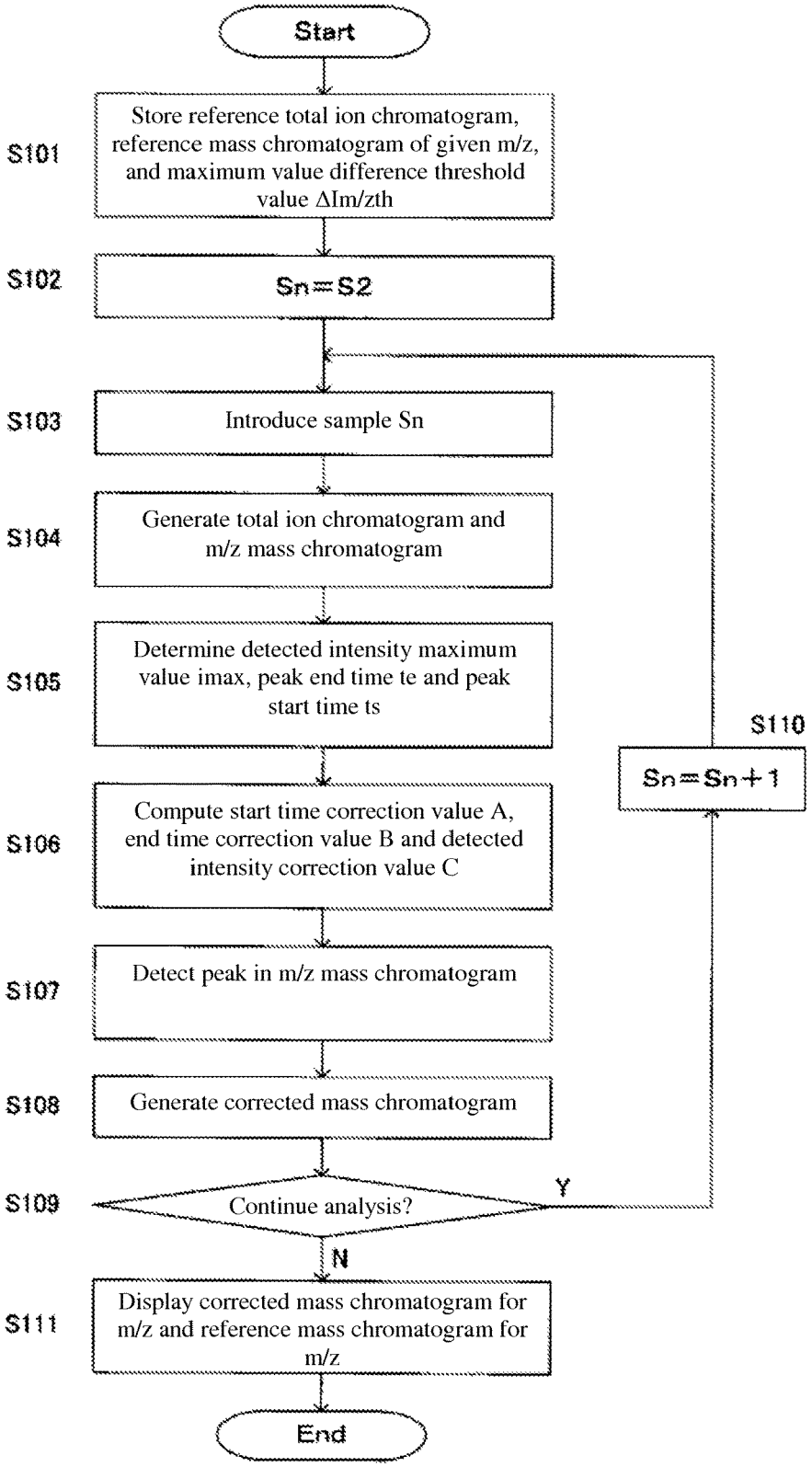
FIG. 7 A flow chart illustrating an example of a screening test method.
Figure 8:
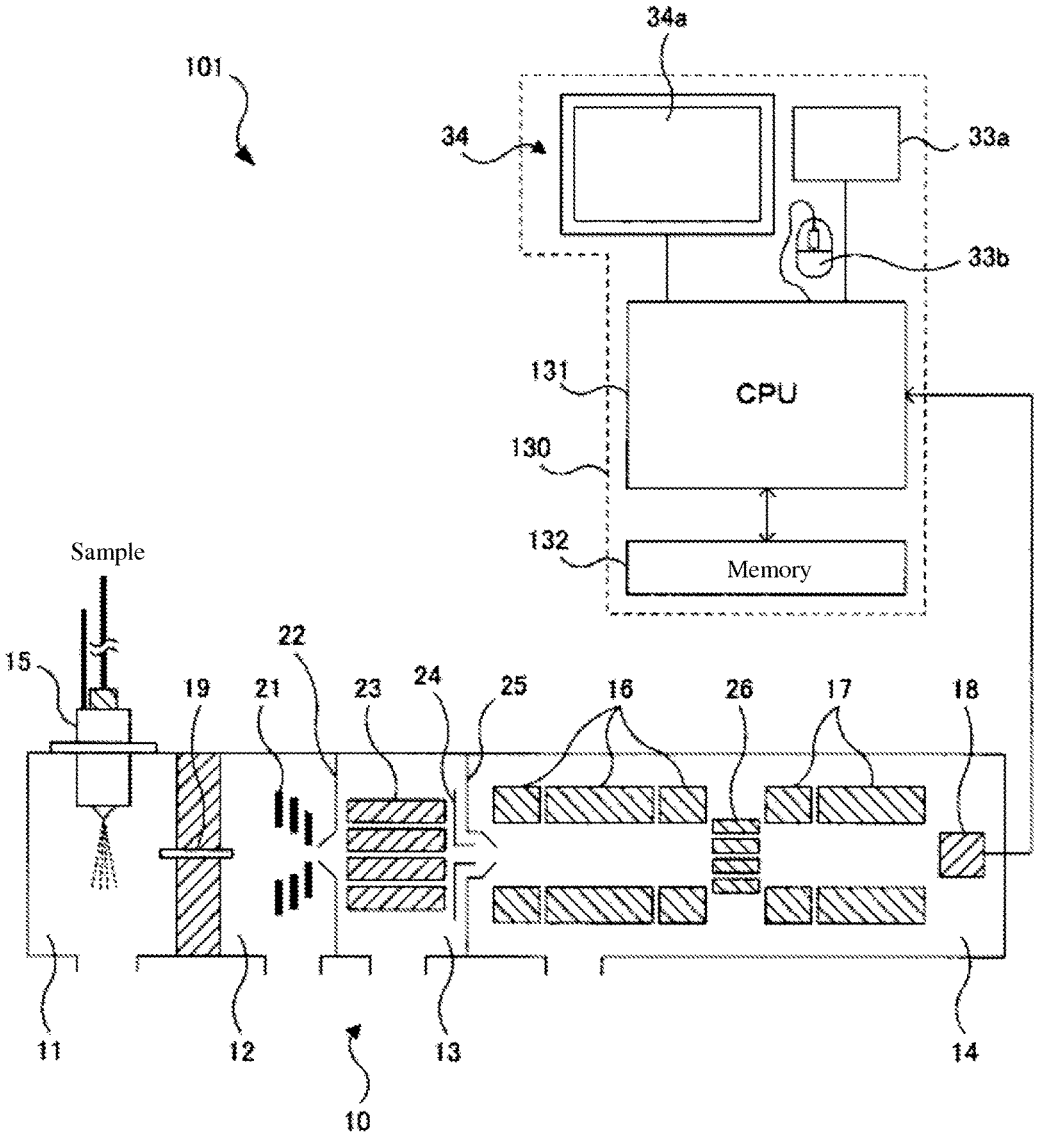
FIG. 8 A schematic diagram illustrating an example of an atmospheric pressure ionization mass analysis device using a flow injection method.
Figure 9:
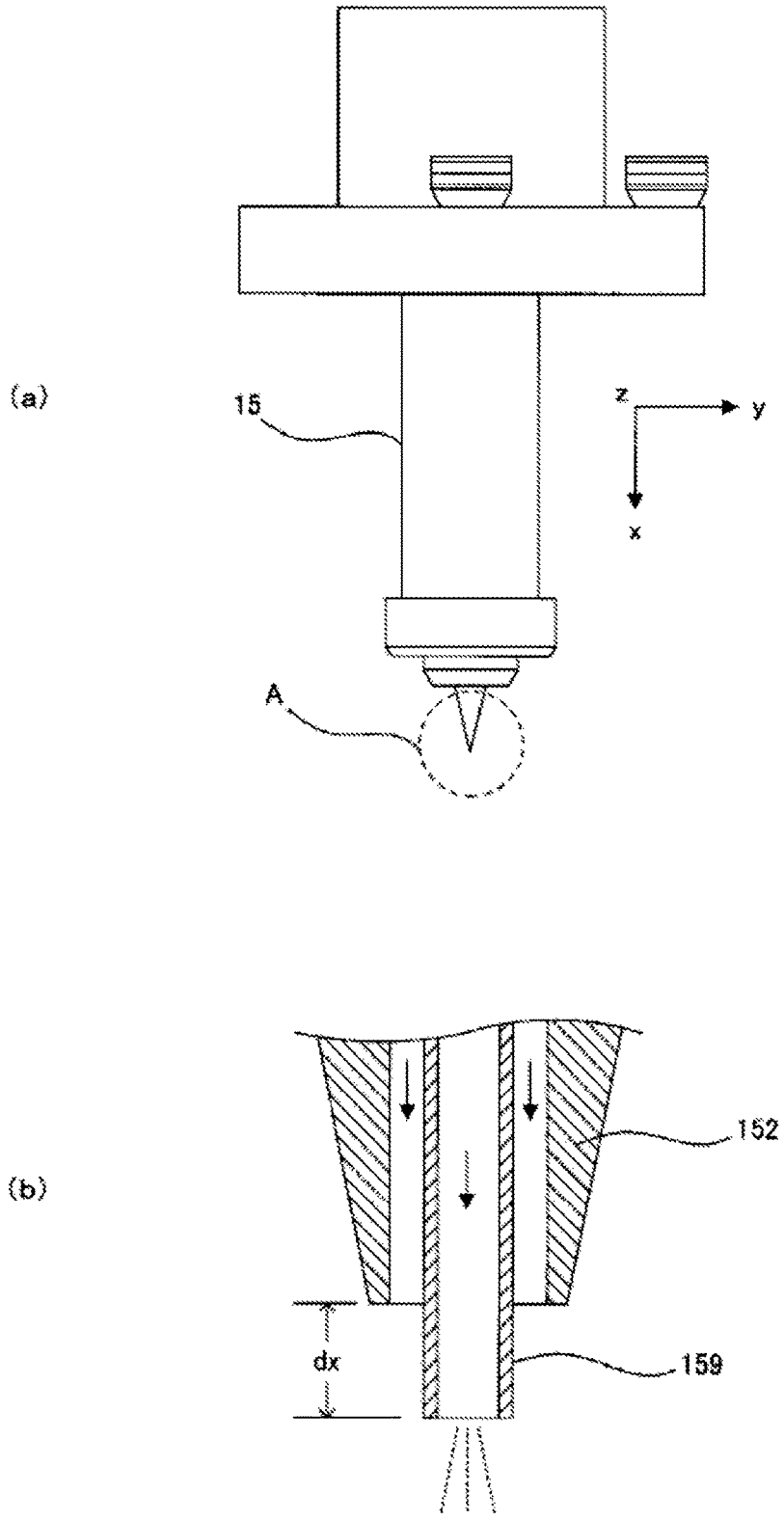
FIG. 9 A side view of a sprayer.

Next, the screening test method using atmospheric pressure ionization mass analysis device 1 will be described. FIG. 7 is a flow chart illustrating an example of a screening test method.

First, in the processing of step S101, a reference total ion chromatogram, m/z reference mass chromatogram and maximum value difference threshold value ΔIm/zth, obtained upon analysis of the reference sample (sample 1) S1, are stored in reference sample storage area 32*a*.

Next, in the processing of step S102, the sample number parameter Sn is set to S2.

Next, in the processing of step S103, the sample Sn is introduced by means of sprayer 15 into ionization chamber 11.

Next, in the processing of step S104, measurement unit 31*a* generates a total ion chromatogram and m/z mass chromatogram for the sample Sn based on the ion intensity signal acquired by detector 18.

Next, in the processing of step S105, determination unit 31*b*, using the total ion chromatogram for the sample Sn, determines the maximum value imax of detected intensity and the peak end time to and peak start time ts.

Next, in the processing of step S106, the computation unit 31*c* computes the start time correction value A, end time correction value B and detected intensity correction value C for the sample Sn.

Next, in the processing of step S107, the detection unit 31*d* detects the peak in a given m/z mass chromatogram by making the peak start time ts and end time te in the given m/z mass chromatogram for sample Sn the same as the peak start time ts and end time te on the total ion mass chromatogram.

Next, in the processing of step S108, the correction unit 31*e* generates a corrected mass chromatogram representing the relationship between detected intensity and time for ions of the given m/z for sample Sn by performing correction using start time correction value A, end time correction value B and detected intensity correction value C.

Next, in the processing of step S109, it is determined if a next sample is to be analyzed. If it was determined that a next sample is to be analyzed, then in the processing of step S110, Sn is set to Sn+1, and the processing returns to step S103.

On the other hand, if it is determined that no next sample is to be analyzed, then in the processing of step S111, the comparison unit 31*f* overlays the corrected mass chromatograms of a given m/z for samples S2 through Sn¬ and the reference mass chromatogram of a given m/z and displays them on monitor screen 34*a*.

Once the processing of step S111 has ended, the flow chart is terminated.

With the atmospheric pressure ionization mass analysis device 1, as described above, not only is the content of ions of a given m/z in blood computed, but also a reference mass chromatogram is compared to a corrected mass chromatogram. Thus, even if the condition of the atmospheric pressure ionization mass analysis device 1 itself is not good, the tester, etc. can find drastically different samples from among Sn samples.

Other Embodiments

In the atmospheric pressure ionization mass analysis device 1 described above, a configuration was employed wherein a first mass analysis unit 16, collision cell 26, second mass analysis unit 17 and detector 18 were provided inside the mass analysis chamber 14, but a configuration in which only the first mass analysis unit and detector are provided may also be employed.

In the mass analysis device 1 described above, a configuration was employed wherein a ionization source comprise a laser source to ionize the sample with direct ionization method or a ionized gas source to ionize the sample with Direct Analysis in Real Time (DART) ionization method.

Field of Industrial Application

The present invention can be utilized for mass analysis devices.

EXPLANATION OF REFERENCES

11: Ionization chamber
14: Mass analysis unit
15: Sprayer
30: Computer (control unit)
31*b*: Determination unit
31*d*: Detection unit

What is claimed:

1. A mass analysis device, comprising;
an ionization source which ionizes a sample
a mass analysis unit into which ions are introduced from said ionization source; and
a control unit which, based on the information acquired by said mass analysis unit, generates a mass chromatogram representing the relationship between detected intensity and time for ions of a given m/z and a total ion chromatogram representing the relationship between detected intensity and time for all ions,
wherein said control unit comprises a determination unit which, using said total ion chromatogram, determines the start time and end time of a single peak in said total ion chromatogram by searching for the single peak based on a maximum value of detected intensity and searching for a peak start time and end time based on a slope of change of detected intensity; and
a detection unit which makes the start time and end time of the single peak in said mass chromatogram the same as the start time and end time of the peak determined by said determination unit in said total ion chromatogram.

2. The mass analysis device described in claim 1, wherein the ionization source ionizes the sample introduced therein with a flow injection method.

3. The mass analysis device described in claim 1, wherein the ionization source ionizes the sample with Direct ion ionization.

4. The mass analysis device described in claim 1, wherein the ionization source ionizes the sample with Direct Analysis in Real Time (DART) ionization.

5. The mass analysis device described in claim 1, characterized in that it comprises a storage unit which stores a reference total ion chromatogram and a reference mass chromatogram of a given m/z obtained upon analyzing a reference sample, and
said control unit comprises: a computation unit which computes a time correction value for performing conversion such that the start time and end time of the peak in said total ion chromatogram will become the same as the start time and end time of the peak in said reference total ion chromatogram, and computes a detected intensity correction value for performing conversion such that the maximum value of detected intensity of the peak in said total ion chromatogram will become the same as the maximum value of detected intensity of the peak in said reference total ion chromatogram;
a correction unit which, by correcting the relationship between detected intensity and time for ions of a given m/z in said mass chromatogram using said time correction value and detected intensity correction value, generates a corrected mass chromatogram representing the relationship between detected intensity and time for ions of the given m/z; and
a comparison unit for comparing the maximum value of detected intensity of the peak in said corrected mass chromatogram and the maximum value of detected intensity of the peak in said reference mass chromatogram.

6. The mass analysis device described in claim 5, characterized in that said comparison unit displays said corrected mass chromatogram and reference mass chromatogram.

7. The mass analysis device described in claim 5, characterized in that said storage unit stores a maximum value difference threshold value, and
said comparison unit determines if the difference between the maximum value of detected intensity of the peak in said corrected mass chromatogram and the maximum value of detected intensity of the peak in said reference mass chromatogram is at or above said maximum value difference threshold value.

8. The mass analysis device described in claim 6, characterized in that said storage unit stores a maximum value difference threshold value, and
said comparison unit determines if the difference between the maximum value of detected intensity of the peak in said corrected mass chromatogram and the maximum value of detected intensity of the peak in said reference mass chromatogram is at or above said maximum value difference threshold value.

9. A mass analysis method, comprising;
ionizing a sample by an ionization source,
introducing ions into a mass analysis unit from said ionization source;
generating by a control unit a mass chromatogram representing the relationship between detected intensity and time for ions of a given m/z and a total ion chromatogram representing the relationship between detected intensity and time for all ions based on the information acquired by said mass analysis unit, determining by the control unit the start time and end time of a single peak in said total ion chromatogram by searching for the single peak based on a maximum value of detected intensity and searching for a peak start time and end time based on a slope change of detected intensity; and making the start time and end time of the single peak in said mass chromatogram the same as the start time and end time of the peak determined by said control unit in said total ion chromatogram.

10. The mass analysis method described in claim 9, wherein the ionization source ionizes the sample introduced therein with a flow injection method.

11. The mass analysis method described in claim 9, wherein the ionization source ionizes the sample with Direct ion ionization.

12. The mass analysis method described in claim 9, wherein the ionization source ionizes the sample with Direct Analysis in Real Time (DART) ionization.

13. The mass analysis method described in claim 9, further comprising:

storing a reference total ion chromatogram and a reference mass chromatogram of a given m/z obtained upon analyzing a reference sample, and computing a time correction value for performing conversion such that the start time and end time of the peak in said total ion chromatogram will become the same as the start time and end time of the peak in said reference total ion chromatogram, and computing a detected intensity correction value for performing conversion such that the maximum value of detected intensity of the peak in said total ion chromatogram will become the same as the maximum value of detected intensity of the peak in said reference total ion chromatogram;

generating a corrected mass chromatogram representing the relationship between detected intensity and time for ions of the given m/z by correcting the relationship between detected intensity and time for ions of a given m/z in said mass chromatogram using said time correction value and detected intensity correction value, and comparing the maximum value of detected intensity of the peak in said corrected mass chromatogram and the maximum value of detected intensity of the peak in said reference mass chromatogram.

14. The mass analysis method described in claim 13, further comprising displaying said corrected mass chromatogram and reference mass chromatogram.

15. The mass analysis method described in claim 13, further comprising:

storing a maximum value difference threshold value, and determining if the difference between the maximum value of detected intensity of the peak in said corrected mass chromatogram and the maximum value of detected intensity of the peak in said reference mass chromatogram is at or above said maximum value difference threshold value.

16. The mass analysis method described in claim 14, further comprising:

storing a maximum value difference threshold value, and determining if the difference between the maximum value of detected intensity of the peak in said corrected mass chromatogram and the maximum value of detected intensity of the peak in said reference mass chromatogram is at or above said maximum value difference threshold value.

17. The mass analysis device described in claim 5, wherein the mass analysis unit is a mass spectrometer (MS).

18. The mass analysis method described in claim 13, wherein the mass analysis unit is a mass spectrometer (MS).

19. The mass analysis device described in claim 1, wherein the ionization source ionizes the sample introduced therein without separation of components by a column.

20. The mass analysis method described in claim 9, wherein the ionization source ionizes the sample introduced therein without separation of components by a column.

* * * * *